United States Patent [19]

Henderson et al.

[11] 4,162,515

[45] Jul. 24, 1979

[54] ELECTRICAL SHOCKING DEVICE WITH AUDIBLE AND VISIBLE SPARK DISPLAY

[75] Inventors: Gary A. Henderson, Arvada; Guy H. Williams, Jr., Parker, both of Colo.

[73] Assignee: American Home Products Corp., New York, N.Y.

[21] Appl. No.: 892,351

[22] Filed: Mar. 31, 1978

Related U.S. Application Data

[63] Continuation-in-part of Ser. No. 752,575, Dec. 20, 1976, Pat. No. 4,092,695.

[51] Int. Cl.[2] ..... F41B 15/04

[52] U.S. Cl. ..... 361/232; 231/2 E; 273/84 ES

[58] Field of Search ..... 361/232; 231/2 E; 273/84 ES; 272/27 N

[56] References Cited

U.S. PATENT DOCUMENTS 3,724,744 4/1973 Carnahan ..... 231/2 E

*Primary Examiner*—Harry E. Moose, Jr.

[57] ABSTRACT

A battery powered, hand-held, lightweight electrical shocking device provides a visible and audible display of sparks continuously upon the operation of a switch. The device is capable of delivering a jolting shock. The display of sparks makes clear the nature of the device and serves as a deterrent to unruly persons. The device is comprised of a non-conductive housing in a generally annular shape, permitting it to be gripped in one hand. On one surface away from the hand are first and second conductive plates separated from each other by an insulator. The electrical circuit comprises a free-running multi-vibrator, a small transformer, a rectifier, a voltage doubler and an internal spark gap. The circuit can deliver a series of short duration, high voltage, low current electrical shocks from two penlight batteries.

10 Claims, 9 Drawing Figures

FIG. 1
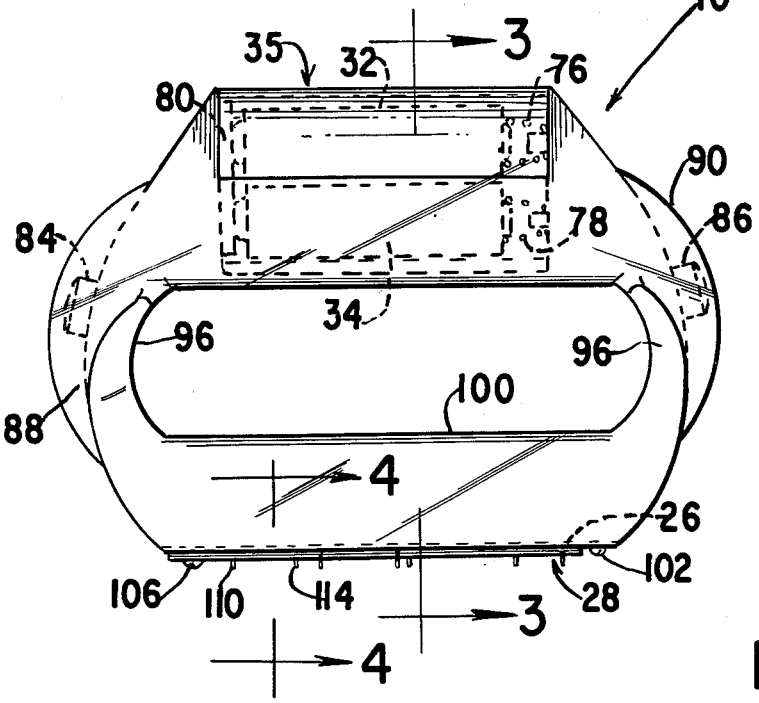
FIG. 2
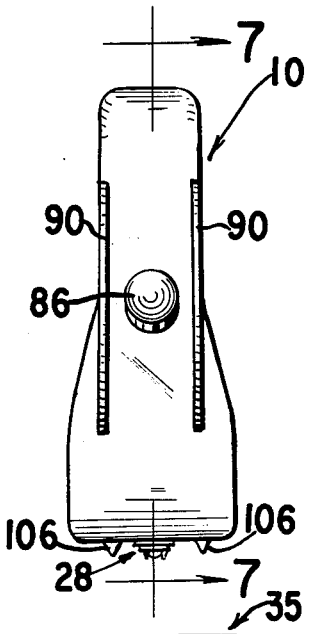
FIG. 3
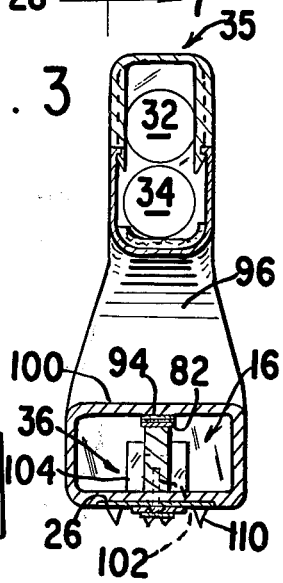
FIG. 5
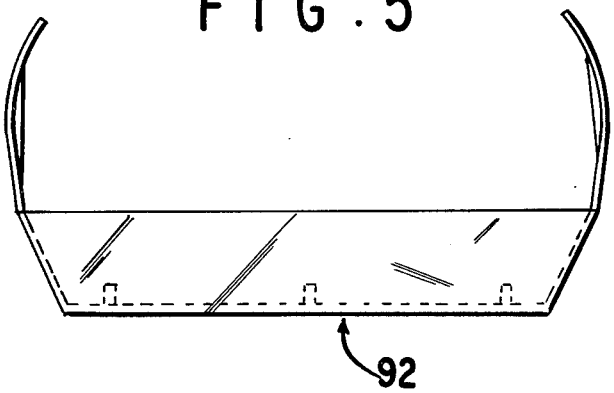
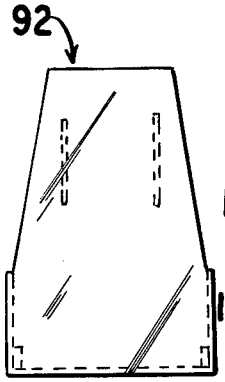
FIG. 6
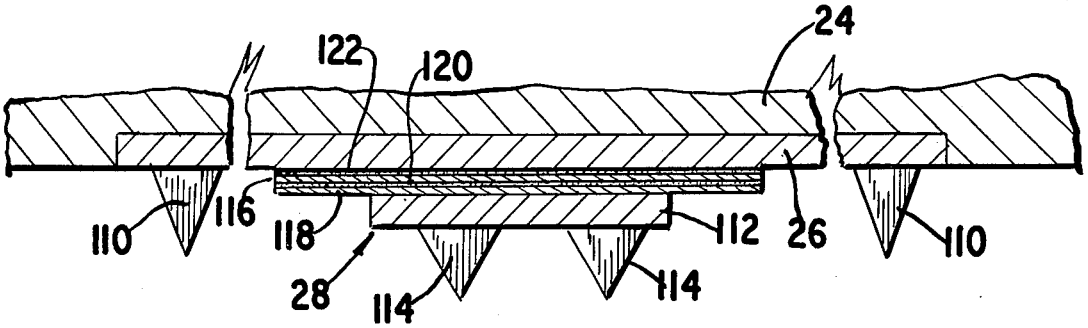
FIG. 4

ELECTRICAL SHOCKING DEVICE WITH AUDIBLE AND VISIBLE SPARK DISPLAY

This application is a continuation-in-part of application Ser. No. 752,575 filed Dec. 20, 1976, now U.S. Pat. No. 4,092,695, which was an improvement on the invention described in application Ser. No. 727,930 filed Sept. 29, 1976 by Gary A. Henderson, which was in turn a division of application Ser. No. 548,590 filed Feb. 10, 1975 by Gary A. Henderson and Douglas K. DuBuque, which is now U.S. Pat. No. 3,998,459 issued Dec. 21, 1976.

The invention relates, generally, to an electrical shocking device which is useful for personal protection. More particularly, it relates to a shocking device which has circuitry and a power source disposed inside of an insulating band adapted to fit around the fingers of one hand, with external conductive plates mounted on the outer surface away from the hand. Such a device enables a weak person to protect herself from an attacker at close quarters with no danger of injury to innocent bystanders.

More particularly, the invention relates to shocking devices which give a visual and audible display of sparks as a deterrent to unruly persons, and which have the capacity to impart a non-fatal, jolting shock.

The use of electrical shocking devices is widespread, reliable shocking devices being recognized as humane devices for handling unruly crowds by many medical personnel and law enforcement officers. Electrical shocking devices are useful and accepted by behavior modification laboratories and many law enforcement persons for training and controlling human and for personal protection. Shocking devices are commonly used in medical and psychiatric therapy.

Although electrical shocking devices have been in use for many years, they have not achieved optimum development. It is known, for example, from U.S. Pat. No. 2,981,465 to provide an electrical prod with a pair of probes, adapted to contact the skin, voltage to the probes being supplied by a transformer, which has its primary winding connected to a battery through make and break contacts. An electro-magnetic relay is provided for effecting movement of the contacts. Such an arrangement has a number of drawbacks. The electromagnetic relay requires a core of considerable size and weight, as well as an energizing current source of substantial volume. The contacts tend to pit, wear out, become easily fouled with dirt and dust, and must be regularly adjusted. Such devices are easily damaged by shock and moisture and usually have short battery life.

Other electrical prods are known, which include a pair of probes for imparting electrical shocks, voltage to the probes being supplied by a transformer which has a primary winding connected to a blocking oscillator. Such prods are described in U.S. Pat. No. 3,819,108. These known prods have the disadvantage of requiring a relatively large transformer and suffer from low output current which produces shock levels insufficient for control. These devices require a direct current source of considerable volume and are usually large and clumsy to handle and store.

Many devices for personal protection from muggers or the like are capable of imparting permanent injury at close quarters. Some such devices are capable of injuring innocent bystanders, if not skillfully handled.

It is an object of the present invention to overcome the shortcomings of the prior art devices.

It is another object of the present invention to provide a shocking device which is compact and light.

It is a further object of the present invention to provide a shocking device of unusually small size.

It is a still further object of the present invention to provide a shocking device which is sufficiently small and manipulatable, to be easily used in close quarters.

It is yet a further object to provide a shocking device which has its main electrical circuit components housed within a closed housing, and therefore removed from the effects of moisture, dust, dirt and other contaminants.

It is a principal object of the present invention to provide a personal protection device, which from an awesome display of electrical sparks and the sound produced by them, serves as a deterrent to physical contact with the holder of the device.

Other and further objects of the invention will be apparent from reading the following description in conjunction with the drawings in which:

FIG. 1 is a side view of the preferred embodiment of the device of the present invention;

FIG. 2 is an end view;

FIG. 3 is a sectional view taken generally along lines 3—3 of FIG. 1;

FIG. 4 is a partial sectional view taken generally along lines 4—4 of FIG. 1;

FIG. 5 is a side view of a protective cover for the embodiment of FIG. 1;

FIG. 6 is an end view of the cover of FIG. 5;

Figure 9:
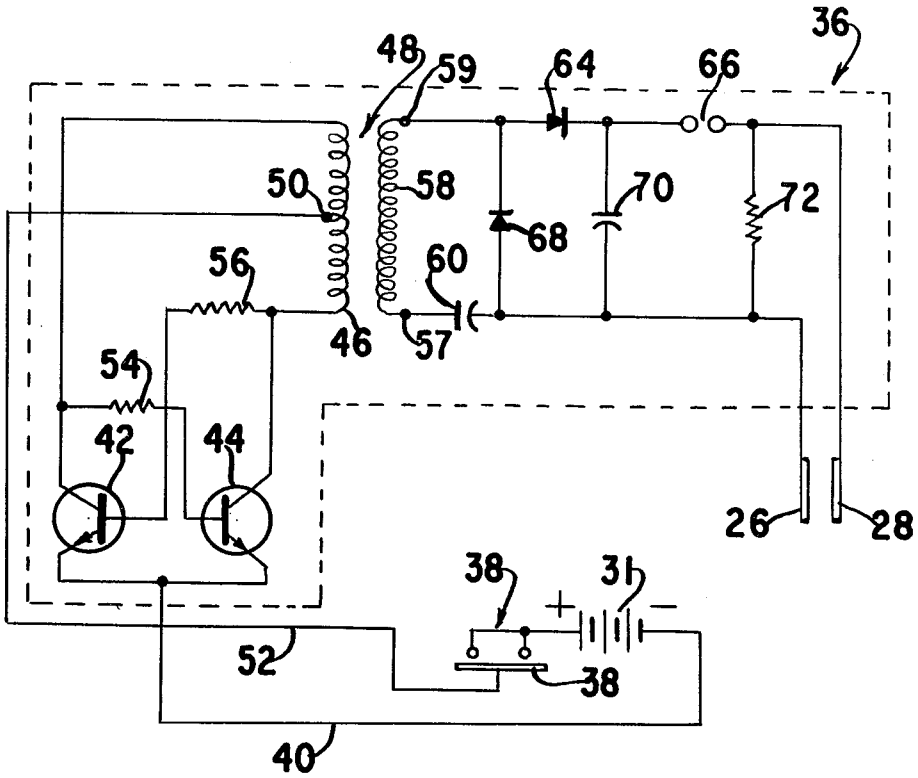
FIG. 9 is a diagram of the electronic circuit means utilized in the preferred embodiment.

The objects of the invention may be achieved with a hand-held electrical shocking device which in the energized condition produces a visible and audible external spark, and delivers a jolting electrical shock when contacting the skin of a human or animal. The device is comprised of a non-conductive, hollow housing which has a hand grip at a first portion. First and second conductive plates are connected to a second housing portion and are spaced apart from each other by a dielectric or an electrically non-conductive member. A low voltage power source is positioned within the housing. An electronic circuit means is connected to the power source and is connected to one of the first and second plates. The electronic circuit means is capable of providing a series of short duration, high voltage, low current electrical impulses to the first and second plates.

As can be seen in the drawings, the shocking device 10 is made up of a housing 12 which may be made of an any suitable non-conductive material such as plastics, particularly polyethylene and polypropylene. Defined in the housing are a battery chamber 14 and a circuit means chamber 16 which are joined at opposite ends by a first connecting chamber 18 and a second connecting chamber 20. An elongated central opening 22 is defined by the chambers 14, 16, 18 and 20. On one outer surface 24, there is connected a first electrode plate 26. A second electrode plate 28 is spaced apart from the first plate 26 by a dielectric member 30. The first plate 26 and second plate 28 are further described below. The fingers of one hand may be placed in the opening 22 with the palm adjacent the batteries chamber 14 which is somewhat flattened.

In the battery chamber 14 there is a power source made up of dry cell batteries 32, 34 which, preferably, are AA size batteries.

An electronic circuit means 36 is fixedly positioned within the circuit means chamber 16.

As is best seen in FIG. 9, the electronic circuit means 36 is shown within the dashed line of the diagram. The power source 31 is connected by a double operator switch 38 through conductor 40 across the emitter and the collector electrodes of a pair of transistors 42, 44. The emitters are connected directly to one terminal of the power source 31. The collectors of the transistors are connected to opposite ends of a center tapped primary winding 46 of a step-up transformer 48, which has its center tap 50 connected to the other terminal of the power source 31 by conductor 52.

The base electrode of the transistor 42 is series connected to the collector of the transistor 44 through a resistor 54. The base electrode of the transistor 44 is series connected to the collector electrode of the transistor 42 by a resistor 56. The two transistors, 42 and 44, thus connected, constitute a free-running multi-vibrator which is activated by closing the switch 38.

The step-up transformer 48 has a secondary winding 58 having two end terminals, 57, 59 one of these end terminals 57 being connected to the first plate 26 through a series-connected capacitor 60. The other end terminal 59 of the secondary winding 48 is connected to the second plate 28 through a series circuit constituted by a rectifying diode 64 and a spark gap 66, the cathode of the diode 64 being connected to one terminal of the spark gap 66. A second diode 68 is connected between the anode of the diode 64 and that terminal of the capacitor 60 which is connected to the plate 26, the cathode of the diode 68 being connected to the anode of the diode 64. A charge capacitor 70 is connected between the cathode of the diode 64 and the anode of the diode 68. A bleeder resistor 72 is connected in parallel with the charge capacitor 70 to assure that a high voltage charge is not stored in the capacitor 70 for any appreciable time after use.

The capacitor 60 and the diode 68 constitute a voltage multiplier stage which, with the rectifier diode 64 and the charge capacitor 70, produces a direct voltage output to the plates 26 and 28 about 1.414 times as large as would be produced were the capacitor 60 and the diode 68 not used. It is to be appreciated that in some embodiments, the capacitor 60 and the diode 68 need not be used and, in still others, additional stages of voltage multiplication may be used.

In an operative embodiment of the present invention, the power source 31 is made up of two 1.5 volt alkaline power cells size AA. Each of the diodes 64 and 68 is an IN 4007 semi-conductive device, rated at 1 ampere, and each of the power transistors 42 and 44 is a transistor manufactured under the number MJE 520 by Motorola. The bleeder resistor 72 is a 2.2 megohm resistor, while each of the resistors 54 and 56 is a 22 ohm, ¼ watt resistor. The capacitors 60 and 70 are each a 0.033 microfarad (μf), 1,000 volt capacitor. The transformer 48 has a small, lightweight ferrite core having three legs, the primary and secondary windings being wound on the center leg.

A practical embodiment of the electrical shocking device may be about 11 centimeters (about 4½ inches) in its longest dimension and about 8 centimeters (about 3 inches) in its shorter dimension and about 3 centimeters (about 1¼ inches) in its thickest dimension. The weight may be about 2 ounces. The device may be readily carried in a pocket or in a purse.

Figure 7:
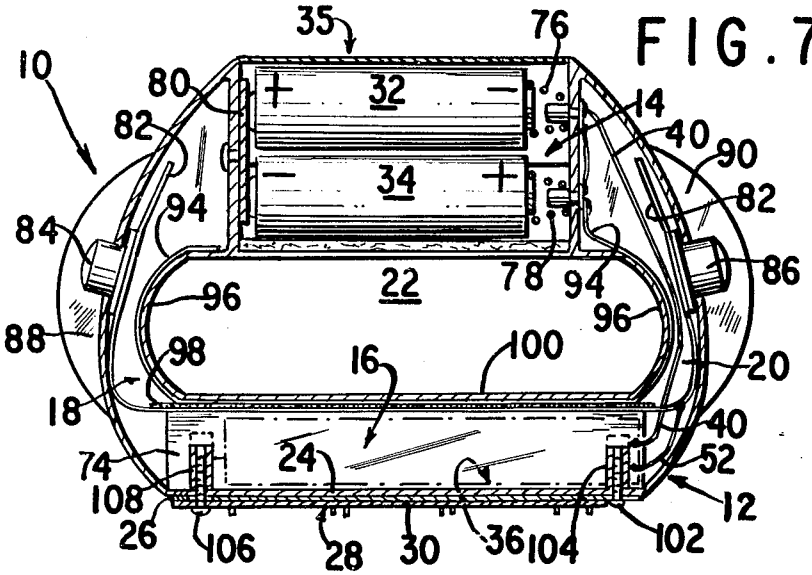
FIG. 7 is a cross-sectional view taken generally alongs lines 7—7 of FIG. 2 showing the relationship of the internal parts of the preferred embodiment.
Figure 8:
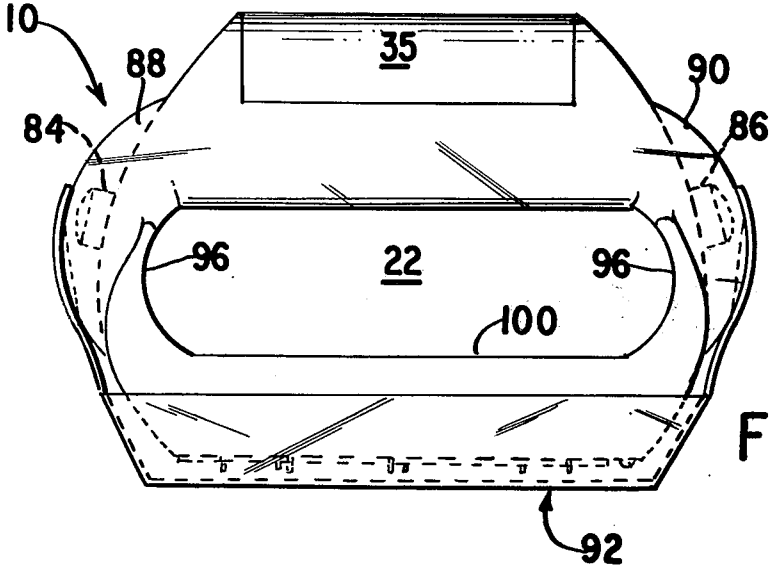
FIG. 8 is an elevational view showing the preferred embodiment with the protective cover in place.

As may best be seen in FIG. 7, the electronic circuit means is made up of a printed circuit board 74 to which are assembled the circuit elements described above. The batteries 32 and 34 are held in place and electrically connected by battery terminal springs 76 and 78, and are connected in series by a shunt, or shorting bar, 80. The switch 38 is constituted by a spring 82, preferably brass, which is generally horseshoe shaped and extends from the first connecting chamber 18 through the circuit means chamber 16 to the second connecting chamber 20. Switch buttons 84, 86 are connected to the spring and are arranged to pass through openings in the housing to be externally operated. The switches are off-positive. There is no connection from the switches to the spark plates. Button guards 88, 90 are integrally cast with the housing of the same material as the housing, and serve to protect the button from inadvertent movement and, secondly, form a base over which a protective cover 92 may be snap fitted when the device is not in use. The cover may be made of any non-conducting material, preferably a clear plastic, such as polyvinyl chloride. Conductor 52 extends from the center tap 50 of the transformer to the switch spring 82, as may be seen in FIG. 7.

As may be seen in FIG. 7, the physical embodiment of the conductor 40 is a conductor extending from the negative battery terminal to terminals on the circuit board 74. A conductor 94, which is preferably a copper foil tape, is connected to the positive battery terminal and wrapped around the inner surface of a wall 96 so that when either of the switch buttons 84 or 86 is depressed, the switch spring 82 contacts the conductor 94 and closes the circuit. An insulator 98, preferably pressure sensitive insulating tape, is disposed between the switch spring 82 and a conductor 94 adjacent the wall 100 of the housing.

The physical connection of the first and second plates may also be seen in FIG. 7. A conductor 102, which may be a machine screw, holds the first plate 26 which is the bottommost plate, to the printed circuit board 74 through a spacer, or standoff, 104. Connector 106, which may be a machine screw, connects the second plate 28 to the printed circuit board 74 through a spacer, or standoff, 108.

The preferred embodiment of the first plate 26 and second plate 28 is shown in FIG. 4. The first plate 26 is desirably relieved into the housing outer surface 24 and has formed on it a plurality of sharp projections 110 which in use serve to penetrate the clothing of an attacker but do not penetrate the skin. That is, they are rather short, electrically conductive projections. The second plate 28 is also in part made up of a plate element 112 which has projections 114 formed on it similar to projections 110. Where the plates 26 and 112 are thin brass sheets, the projections 110, 114 may be formed by cutting and bending out small segments.

It has been found advantageous that the second plate 28 be made up of a number of plate elements, besides plate element 112. These elements comprise metallic layers 116, 118 which are separated from each other by a dielectric member 120 and from plate 26 by dielectric member 122. Preferably, an adhesive metalized tape is used, layer upon layer, to provide the elements 116, 118,

120 and 122. Only two of such metalized layers, 116 and 118, are shown. Additional layers may be advantageous in certain embodiments.

It has been found that a spark jumping between plates 26 and 28 may be made to jump at first one point and then another to produce a "dancing" effect when the additional metallic layers, 116 and 118, are provided in addition to plate 28. Without the additional metallic layers 116 and 118, it has been found that after extended use, the sparking tends to occur in the same place which is less desirable than the dancing effect.

A battery cover 35 is provided which is preferably made of the same material as the housing, and may be made to snap fit into the housing for easy access to the batteries.

What is claimed is:

1. A hand-held electrical shocking device which in the energized, operative condition produces a visible and audible external spark and is capable of delivering a jolting electrical shock comprising a. a non-conductive hollow housing having a hand grip at a first housing portion;

b. first and second conductive plates connected to a second housing portion and being spaced apart from each other by a non-conductive member;

c. a low voltage power source positioned within said housing;

d. an electronic circuit means coupled to said power source and said first and second plates, said electronic circuit means being adapted to provide a series of short duration, high voltage, low current electrical impulses to said first and second plates.

2. A hand-held electrical shocking device which in the energized, operative condition produces a visible and audible external spark and is capable of delivering a jolting electrical shock comprising a. a non-conductive, generally annular housing;

b. a first plate supported by a portion of said housing;

c. at least one second plate insulatingly connected to said first plate;

d. a low voltage power source positioned within said housing;

e. an electronic circuit means positioned within said housing coupled to said power source and said first and second plates, said electronic circuit means being adapted to provide a series of short duration, high voltage, low current electrical impulses to said first and second plates.

3. A device as defined in claim 2 where said second plate is spaced apart from said first plate by a dielectric member and further comprises a plurality of subplates separated from each other by dielectric members and electrically coupled to each other by a conductive member.

4. A device as defined in claim 2 in which said second plate is narrower than said first plate.

5. A device as defined in claim 2 in which said second plate is narrower than said first plate and is positioned substantially in the middle of said first plate.

6. A device as defined in claim 2 in which a plurality of projections are defined on the outer surfaces of said first and second plates.

7. A device as defined in claim 2 in which said electronic circuit means further comprises at least one switch.

8. A device as defined in claim 3 in which said second plate comprises a plurality of layers of metalized tape adhesively connected to each other.

9. A hand-held electrical shocking device for producing a visible and audible external spark and capable of delivering an electrical shock comprising a. a non-conductive housing having 1. a battery chamber, 2. a circuit means chamber, 3. first and second connecting chambers connected to each of said battery chamber and said circuit means chamber, 4. an elongated central opening defined by said chambers;

b. a first plate supported on the outer surface of said circuit means chamber;

c. at least one second plate spaced apart from said first plate by a dielectric member;

d. batteries supported in said battery chamber;

e. an electronic circuit means positioned within said circuit means chamber and coupled to said batteries and said first and second plates by connectors positioned within said connecting chambers.

10. A device as defined in claim 9 where said battery chamber is flattened and adapted to engage the palm of a hand when fingers are inserted in said elongated central opening.

* * * * *